US006585315B1

(12) United States Patent
Vail

(10) Patent No.: US 6,585,315 B1
(45) Date of Patent: Jul. 1, 2003

(54) FOLDABLE STOOL AND STRINGED INSTRUMENT STAND

(76) Inventor: Nicholas C. Vail, 6087 "d" Jacaranda Way, Carpinteria, CA (US) 93013

( * ) Notice: Subject to any disclaimer, the term of this patent is extended or adjusted under 35 U.S.C. 154(b) by 0 days.

(21) Appl. No.: 10/207,444

(22) Filed: Jul. 26, 2002

(51) Int. Cl.[7] ..... A47C 7/62
(52) U.S. Cl. ..... 297/186; 84/327
(58) Field of Search ..... 297/186; 84/327

(56) References Cited

U.S. PATENT DOCUMENTS

| | | | | |
|---|---|---|---|---|
| 4,359,243 A | | 11/1982 | Crutcher | 297/16 |
| 4,951,996 A | | 8/1990 | Shannon | 297/42 |
| 5,383,634 A | | 1/1995 | Liao | 248/166 |
| D355,773 S | | 2/1995 | MacOwan | D6/335 |
| 5,465,673 A | | 11/1995 | Ma | 108/118 |
| 5,789,687 A | | 8/1998 | Johnson | 84/387 |
| 5,857,649 A | * | 1/1999 | Eason | 248/164 |
| 5,957,417 A | | 9/1999 | Yu | 248/166 |
| 6,073,999 A | | 6/2000 | Crane | 297/186 |
| D431,938 S | | 10/2000 | Lewis | D6/480 |
| 6,326,531 B1 | * | 12/2001 | Bremner | 84/327 |

FOREIGN PATENT DOCUMENTS

WO WO 99/20156 4/1999

* cited by examiner

*Primary Examiner*—Anthony D. Barfield
(74) *Attorney, Agent, or Firm*—Cislo & Thomas LLP

(57) ABSTRACT

A foldable stool and stringed instruments stand wherein the stool in the open position provides an easy means of resting a stringed instrument thereon and also allows for the sitting thereupon by the musician during playing of the instrument and which foldable stool is easily folded for ease of aspportation.

9 Claims, 4 Drawing Sheets

FOLDABLE STOOL AND STRINGED INSTRUMENT STAND

BACKGROUND OF THE INVENTION

1. Field of the Invention

The present invention relates to a collapsible stool of the type that would be used by a musical artist who plays a stringed instrument having a body and a neck portion, wherein the musician may carry the stool around in collapsed fashion in an easy manner and when the stool is erect, have a place not only to sit but also to place the instrument, such as a guitar, when the musician is no longer playing the same.

2. Description of the Related Art (General Background)

In the musical area, musicians must of course carry their musical instruments and many times the chair or stool upon which they will sit so they may be comfortable during their period of play. It is often very difficult to be able to have an easily asportable chair or stool which is easily collapsed and easily opened and one which may be sat upon and alternately act as a stand for the musical instrument when the musician is no longer playing the same.

It is important that the musician have the ability to easily carry a portable chair or stool and one that is of low cost and easy maintenance because of the abuse that the stool will encounter in the musician's travels. It is also ideal if the same collapsible stool can act as an instrument holder during breaks or intermissions during the time that the musician is not playing the instrument.

While some of the prior art has suggested musicians' portable seats, such as U.S. Pat. Nos. 4,951,996, 4,359,243, and U.S. Pat. No. 5,465,673, while approaching a desiratum for musicians, has failed to provide for a specific, uniquely configured collapsible stool or chair that would be intended specifically for stringed instruments having a body and an extending neck such that the collapsible stool may be easily carried, easily opened to the sitting position and when not sat upon, provide a musical instrument stand.

Others have tried to overcome some of the difficulties in prior art as, for example, U.S. Design Pat. No. 355,773 but none as indicated herein before have been suitable for the intended purposes of the herein disclosed invention.

SUMMARY OF THE INVENTION

The FOLDABLE STOOL AND STRINGED INSTRUMENT STAND of the instant invention overcomes the short comings of the prior art and comprises a support means comprising a first and second pair of leg members for moving from a first closed parallel position to a second open position, with the first and second pair of leg members crossing to form an "X" configuration. A seat is attached to the support means and the seat has an indentation or curvilinear configuration at the front of the stool so it as to be able to receive the upper neck portion of a stringed instrument such as a guitar. Attachment means are positioned intermediate the leg members and the seat for allowing the leg members to swivel from the first parallel position to the second "X" configured open position. Towards the bottom of the elongate leg members there is at least one bracket being aligned with the indentation or curvilinear groove of the seat whereby the body of a stringed instrument such as a guitar is supported off the floor by the bracket member and the neck is allowed: to be received within the indentation of the seat when the stool is in the open position.

OBJECTS OF THE INVENTION

It is therefore the principal object of the invention to provide a practical stool or chair which is to be used by musicians playing stringed instruments and in particular, guitars.

It is another important object of the present invention to provide a collapsible stool that is of low maintenance, low cost of construction and which is easy to carry and which performs a variety of needs from forming a stool in the open position upon which a musician may sit and also providing a musical instrument holder when the musician is not playing the instrument.

It is still another important object of the invention to provide a collapsible, easily asportable stool that has relatively few mechanical parts, which is easy to operate and which is easily opened to an open position to allow sitting thereon, and which is easily collapsed for ease of transportation These and other objects and advantages of the present invention will be apparent from a review of the following specification and accompanying drawings.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

Figure 1:
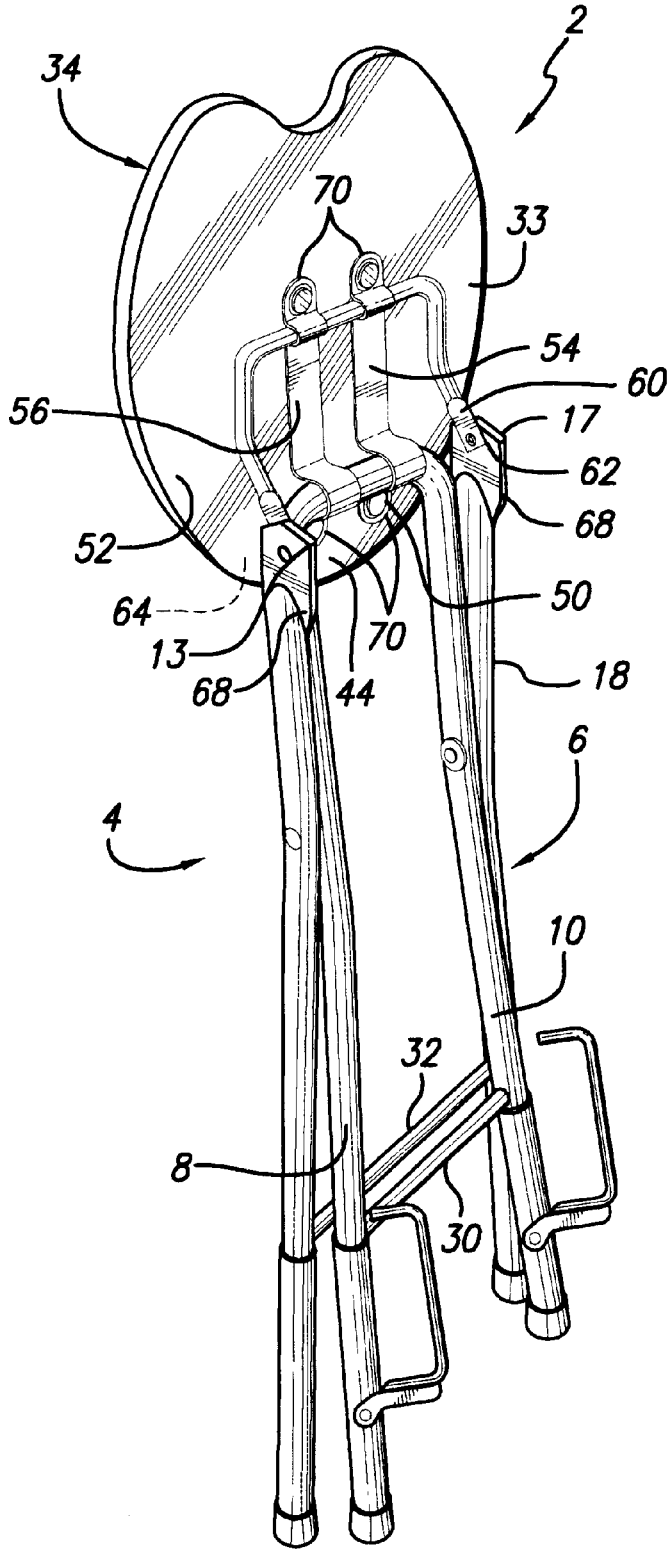
FIG. 1 is a perspective view of the stool in the collapsed position.
Figure 2:
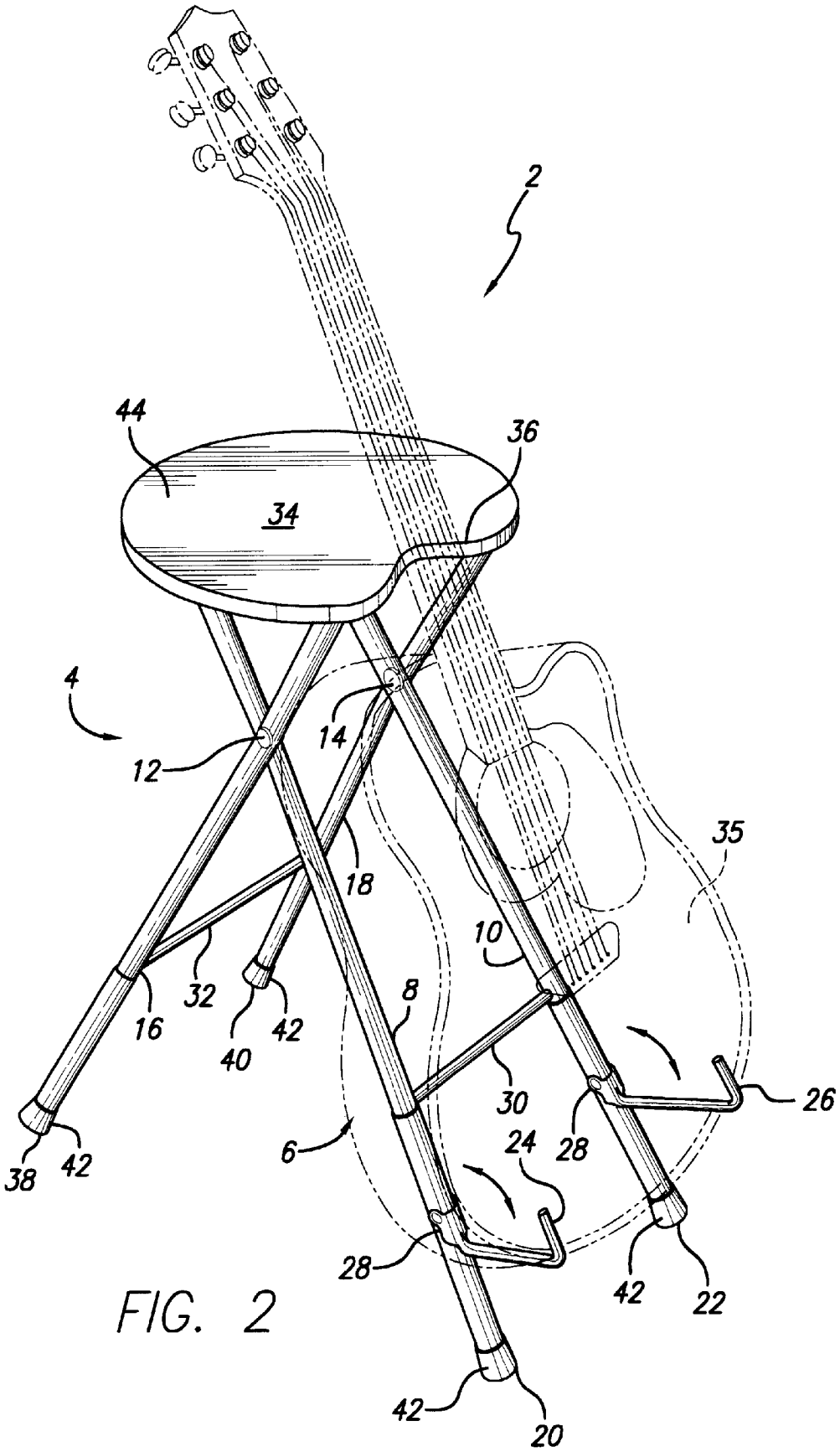
FIG. 2 is a perspective of my stool in the open position with a stringed instrument, such as a guitar, being shown in phantom line for illustration purposes only.

Referring to the figures of drawings wherein like numerals of reference designate like elements throughout, it will be seen that the FOLDABLE STOOL AND STRING INSTRUMENT STAND 2 of the invention comprises a support means 4 made up of a first pair of legs 6 comprising individual elongate legs 8 and 10 hingedly connected through securement means such as rivets 12 and 14 to legs 16 and 18 making up the second pair of leg members 4. As noted in the figures the support means 4 and 6 are collapsible into a parallel position as shown in FIG. 1 and openable into an "X" configuration as shown in FIG. 2.

Spaced above the termini 20 and 22 of legs 8 and 10 are U-shaped bracket members 24 and 26 pivotally secured by rivets or the like and in this instance rivets being used and which are designated at 28. Pivotal movement in the direction of the arrows allows for compact placement of the bracket members 24 and 26 for travel as shown in FIG. 1. The legs 8 and 10 have positioned above the U-shaped brackets 24 and 26 a support cross piece 30 upon which a musician's feet may rest, as will be further described.

Similarly, cross piece 32 is provided on legs 8 and 10 for structural rigidity purposes and is provided at about the same position on legs 16 and 18 as cross piece 30 is positioned on legs 8 and 10.

A seat 34, in this instance of wood and having a polygonal shape, has an indentation 35 of curvilinear configuration is secured to the pairs of leg members 4 and 6 as will be described. Obviously, the seat 34 may be of metal and have conventional padding. It will be noted that the seat 34 is of ample or sufficient size to accommodate the buttocks portion of a musician, not shown. Similarly the indentation or curvilinear groove 36 is so fashioned so as to receive the neck portion of a stringed instrument such as guitar 35 shown in phantom line in FIG. 2. Obviously, the indentation 36 may take a plurality of shapes, it only being important that the upper or neck portion have some resting place.

Figure 3:
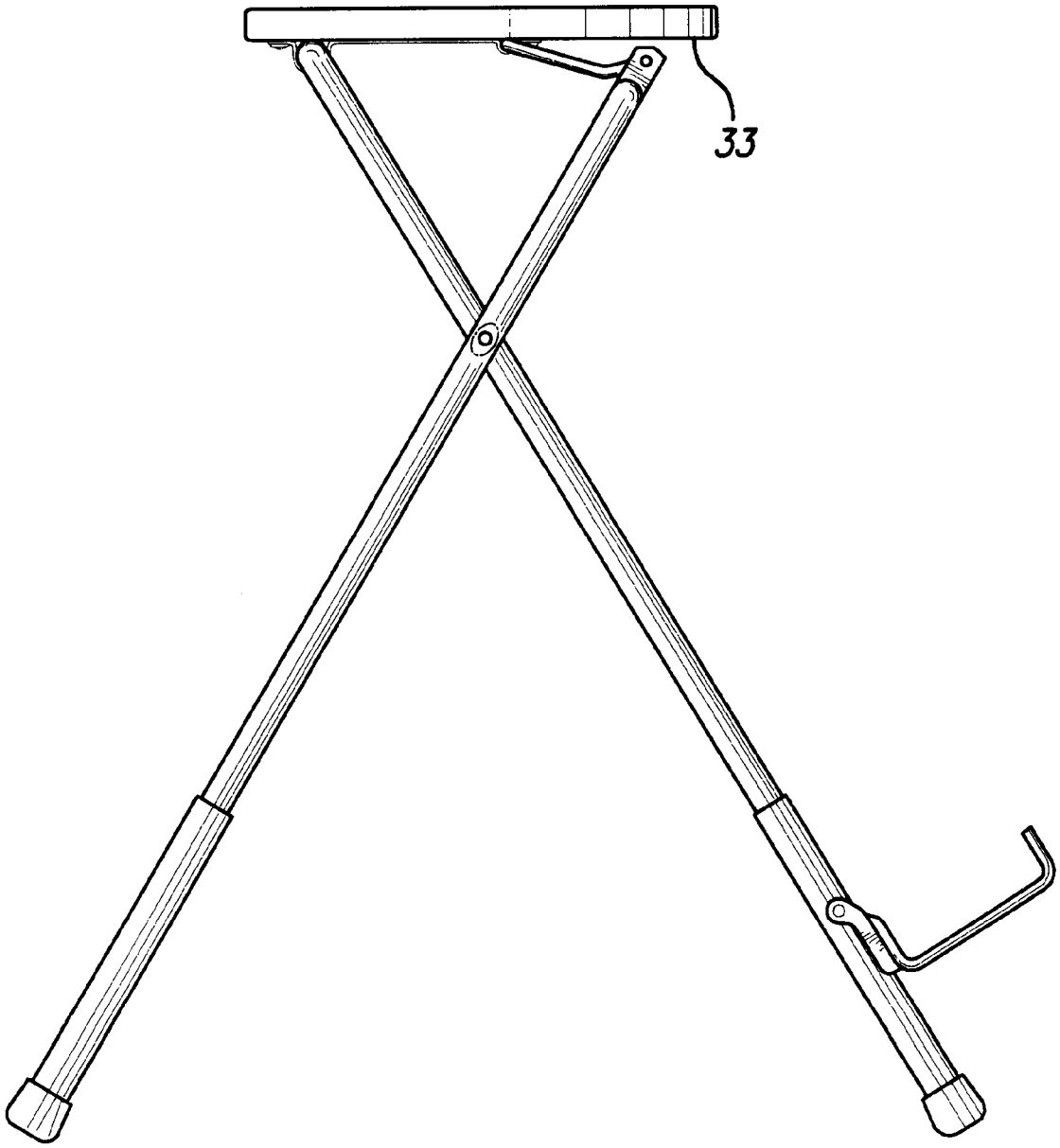
FIG. 3 is a side view of the stool shown in FIG. 2.
Figure 4:
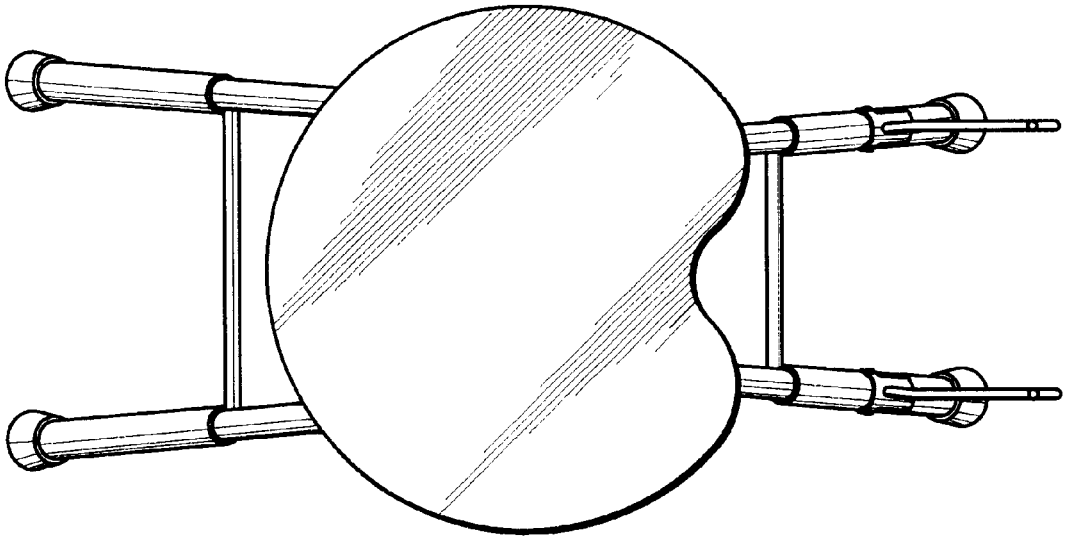
FIG. 4 is a top view of the stool shown in FIG. 3.
Figure 5:
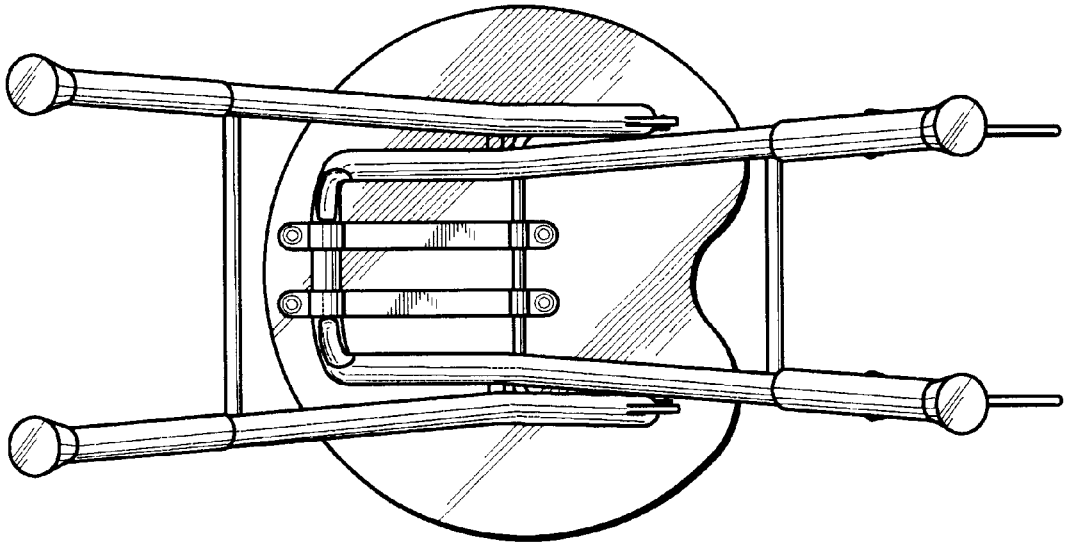
FIG. 5 is a bottom view of the stool shown in FIG. 3

The legs 16 and 18 being elongate in configuration have termini 38 and 40. Each of the termini 20, 22, 38 and 40 are provided with rubber feet 42 of the type ubiquitously found and which provides a non-slip means by which the stool 2 may be positioned upon a supporting surface such as a floor. The upper termini 15 and 17 form an abutment stop to engage the undersurface 33 of seat 34 when the device 2 is in the fully opened position, as shown in FIG. 3.

The seat 34 is also ideally configured so as to :have a depending portion 44 as best seen in FIG. 1 for ease of carrying the stool when in the collapsed position as shown in FIG. 1.

The first pair of legs 6 comprising extending leg members 8 and 10 may be of one piece construction having a U-shaped portion 50 at the top thereof by which the first pair of legs 6 may be swivelly attached to the undersurface 52 of seat 34 by means of opposed straps or brackets 54 and 56. The second pair of legs 4 made up of leg members 16 and 18 are hingedly or swivelly connected by means of rod U-shape bracket member 60 having ends 62 and 64 which are hingedly or swivelly connected to the upper portions 66 and 68 of leg members 16 and 18 respectively.

In this particular instance the seat 34 is illustrated as being of wood construction such that the strap brackets 54 and 56 are secured to the underside 52 of seat 34 by means wood screws 70. Obviously, where the seat 34 is of metal, tack welds or other well known means of securement may be used.

Thus has been described an easily asportable musician's stool 2 which in the collapsed position as shown in FIG. 1 is easily carried and because of the simplicity of construction and the paucity of intricate moving parts makes for a convenient sitting means that a musician may carry with him or her very easily when in the collapsed position. When the musician arrives at the "gig" site the musician may easily open the stool 2 into the position shown in FIG. 2 and may sit thereupon and rest his or her feet on either crossbar 30 or 32, depending upon his orientation with respect to the stool 2. The brackets 24 and 26 will be in the fully raised position. When the musician, guitar player or the like finishes his set he may then pivotally rotate the brackets 24 and 26 to the instrument receiving portion and place his or her stringed instrument onto the brackets 24 and 26 and rest the neck of the stringed device into the to indentation 36 of seat 34.

Thus, there has been described a collapsible or foldable string instrument stand and stool which is of light weight construction, easily carried, easily maintained and fulfills the needs of a musician to not only alleviate his or her standing discomfort but also to provide a safe haven for his or her instrument once he or she is no longer playing the same.

While the present invention has been described with respect to specific materials and construction and specific means of attachment of the components making up the versatile stool of the invention, those of ordinary skill in the art will recognize that other means of securement as well as other materials of construction will make themselves known to those of ordinary skill in the art and all such changes and modifications are intended to be covered by the appended claims.

EXAMPLE

A foldable stool and stringed instrument device as depicted in the drawings was constructed wherein the overall device 2 had a height of approximately twenty-seven inches and was made of one inch tubular steel for the foldable legs and wherein the bracket members holding the body of the stringed instrument were approximately six inches from the floor and were pivotally mounted so that they would fold inward towards the leg upon which they were secured for further ease of maneuverability. Additionally, the cross pieces or foot rests for the stool were approximately nine inches from the floor and it is found that such placement provides for ease of sitting on the stool while the musician is playing the stringed instrument. The seat is made of wood of approximately one inch in thickness and is circular-like in configuration with the exception of the indentation and has a diameter of approximately thirteen inches. The curvilinear recess is about 1 and a half inches deep and thus provides sufficient resting area for the neck of the stringed instrument.

What is claimed is:

1. A foldable stool and stringed instrument stand comprising the combination of:

a support means comprising a first and second pair of leg members for moving from a first closed parallel position to a second opened position with the first and second pair of leg members crossing to form an "X" configuration;

a seat attached to said support means, said seat having an indentation adapted to receive the neck portion of a stringed instrument;

attachment means positioned intermediate said leg members and said seat for allowing said leg members to swivel from said first parallel position to said second "X" configured opened position; and a U-shaped bracket member pivotally secured to each of the front of one of said leg members and being aligned with the indentation of said seat whereby the body of a string instrument is supported by said U-shaped bracket member and the neck thereof is received within said indentation of said seat wherein said U-shaped bracket member is pivoted downwardly in a string instrument supporting position.

2. The foldable stool and stringed instrument stand in accordance with claim 1 wherein said seat is constructed of wood.

3. The foldable stool and stringed instrument stand in accordance with claim 1 wherein strap members hold the upper portion of said first and second pair of leg members to the underside of said seat.

4. The foldable stool and stringed instrument stand in accordance with claim 3 wherein the upper portion of said first pair of leg members is of Ushaped construction and is retained by said strap members.

5. The foldable stool and stringed instrument stand in accordance with claim 4 wherein each of said first and second pairs of leg members have a cross member therebetween so as to provide rigidity of the support and a footrest.

6. The foldable stool and stringed instrument stand in accordance with claim 5 wherein said leg members have rubber end portions.

7. The foldable stool and stringed instrument stand in accordance with claim 6 wherein said indentation is curvilinear in configuration.

8. The foldable stool and stringed instrument stand in accordance with claim 7 wherein said first and second pair of leg members are of metal construction.

9. A foldable stool and stringed instrument stand comprising the combination of:

a support means comprising a first and second pair of leg members formed of metal for moving from a first closed parallel position to a second opened position with the first and second pair of leg members crossing to form an "X" configuration;

a seat attached to said support means, said seat having a curvilinear indentation adapted to receive the neck portion of a stringed instrument;

attachment means positioned intermediate said leg members and the underside of said seat for allowing said leg members to swivel from said first parallel position to said second "X" configured opened position; and a pair of U-shaped extending bracket members pivotally secured to each of the front of one of said leg members and being aligned with said curvilinear indentation of said seat whereby the body of a stringed instrument may be supported by said U-shaped bracket members wherein said U-shaped extending bracket members are positioned in a string instrument supporting position and the neck thereof is received within said indentation of said seat.

* * * * *